US005957183A

United States Patent [19]

Prince

[11] Patent Number: 5,957,183

[45] Date of Patent: Sep. 28, 1999

[54] BLACKOUT BLIND

[75] Inventor: Kendall W. Prince, Mesa, Ariz.

[73] Assignee: Royal Wood, Inc., Phoenix, Ariz.

[21] Appl. No.: 08/916,898

[22] Filed: Aug. 22, 1997

[51] Int. Cl.[6] ..... E06B 9/30

[52] U.S. Cl. ..... 160/168.1 R; 160/173; 160/176.1 R; 160/178.1 R; 160/236

[58] Field of Search ..... 160/168.1 R, 176.1 R, 160/173, 178.1 R, 236, 172, 177, 166.1 R

[56] References Cited

U.S. PATENT DOCUMENTS

| | | | |
|---|---|---|---|
| 2,107,432 | 2/1938 | Thompson | 160/236 X |
| 2,158,682 | 5/1939 | Sweney | 160/236 X |
| 2,209,355 | 7/1940 | Schmitz | 160/236 |
| 2,325,003 | 7/1943 | Beckwith et al. | 160/236 |
| 2,334,454 | 11/1943 | Taylor et al. | 160/236 |
| 2,723,716 | 11/1955 | Berni | 160/168.1 R |
| 2,804,924 | 9/1957 | Dennen | 160/176.1 R |
| 3,110,936 | 11/1963 | Berard | 160/236 |
| 3,377,745 | 4/1968 | Seth | 160/236 |
| 3,971,427 | 7/1976 | Coldewey et al. | 160/168.1 R |
| 4,799,526 | 1/1989 | Reeves | 160/168.1 R |
| 5,375,642 | 12/1994 | Gaber et al. | 160/168.1 R |
| 5,409,050 | 4/1995 | Hong | 160/168.1 R |
| 5,423,367 | 6/1995 | Kataoka et al. | 160/168.1 R |
| 5,657,806 | 8/1997 | Hung | 160/236 X |

*Primary Examiner*—Daniel P. Stodola
*Assistant Examiner*—Bruce A. Lev
*Attorney, Agent, or Firm*—Rader, Fishman & Grauer PLLC

[57] ABSTRACT

A horizontal window blind for virtually total blocking the passage of light has a plurality of slats formed from first and second portions parallel to each other. The portions are interconnected by a transition portion, and a flange portion is provided projecting at an obtuse angle from the second portion. At least one opening is made in the flange portion to pass a lifting cord therethrough. The slats are supported by horizontal cords which are attached to a set of vertical cords. A spacing between the horizontal cords is fixed to a distance which permits an outer edge of the first portion to cover the flange portion with the cord passage opening and at least a part of the second portion when the slats are tilted into the vertical position. Because of the shape of the slats and the relative positioning of the slats when tilted into the vertical position, the lifting cord does not find its way between the slats and light is fully blocked by the blind.

3 Claims, 2 Drawing Sheets

BLACKOUT BLIND

BACKGROUND OF THE INVENTION

1. Field of the Invention

The present invention relates generally to horizontal blinds, and specifically relates to blinds which prevent light passage when closed.

2. Description of the Prior Art

Horizontal or venetian blinds have existed for many years and have been used to cover windows, sliding glass doors and other openings to control the amount of light passing through the opening. They are made of a number of thin, horizontal wooden, metal, or plastic slats that can be set together at any angle to regulate the light and air passing through or be drawn up together to the top of the window by means of cords. The blinds serve functional, decorative, and privacy enhancing functions. A conventional blind system includes a head box which encloses the mechanism for adjusting the tilt of the slats and for raising and lowering the blind. Hanging down from the head box is a plurality of thin and relatively narrow slats which, depending on their length, are supported by at least two sets of ladder-like operating cords. Lifting cords connected to a lowermost slat or a bottom rail pass through each slat.

When the slats are tilted in a horizontal position, light passes through the blind. When the slats are tilted into a vertical position, the light is blocked. Since each slat is supported by a "rung" or horizontal cord attached to the set of operating cords, tilting the slats into the vertical position puts the horizontal cords between adjacent slats. This prevents the slats from fully closing. As a result, such prior art blind systems pass a certain amount of light. The presence of the lifting cords between the slats causes the separation of the closed slats to further increase, thereby increasing the amount of light which comes through the blind. Also, through holes for the lifting cords represent themselves an additional source of light leakage. That is, when the slats are tilted to the vertical position to block light, some light inevitably passes through the holes and slots in the blind. The overall effect of the holes and the presence of the horizontal cords between the slats when in the vertical position is that the blind does not fully block all of the light. This leads to a blind which is not as aesthetically pleasing as possible and has a reduced ability to provide privacy. In addition, light spots resulting from sunlight beams passing through the holes may in time leave fading spots on the walls and items hanging thereon.

Though venetian blinds have been used for several centuries and many attempts have been made to improve them, those numerous developments have not significantly changed this classic product other than on a refined scale such as narrow operating cords replacing wide ladder tapes, conversion to contemporary materials such as aluminum and plastics, and component improvements such as high-ratio gear wands replacing direct-drive tilt cords.

There appears to be at least two causes for the lack of solution to this light leakage problem. One is that venetian blinds have been the subject of continuous refinement over such a long time by so many contributors that they were believed to have evolved to their most efficient generic form.

The second cause is that in solving one problem the improvements either have inadvertently created another one or have compromised a prior accepted benefit to a level below consumer acceptance.

Illustrative of this dilemma is the problem of light leakage through blinds that has been addressed by many. U.S. Pat. No. 2,107,432 discloses a window covering made of pivoting louvers mounted at one pair of corners of the slat. When placed in the closed position, the louvers overlap one another. When the louvers are placed in the open position, they allow the most light to pass through the blind. The angle of the louvers is adjusted by a mechanical device causing the louvers to pivot. This design makes no provision for raising the louvers. Because the louvers cannot be raised, the window will always be partially covered by the blind.

There have been approaches to solve the light leakage problem by forcing the slats together when they are in the vertical position. U.S. Pat. No. 2,804,924 discloses a horizontal blind having a set of paired pivoting rods anchored to the top and bottom of the window casement. When it is desired to fully close the blind, the paired pivoting rods are actuated to clamp the slats together preventing the passage of light. To fully close the blind requires two actions; 1) tilting the slats to the vertical position, and 2) clamping the slats together with the pivoting rods. When the blind is raised, the rods remain in the window. The permanent presence of the rods is unsightly and prevents objects such as fans and air conditioning units from being placed in the full width of the window.

U.S. Pat. No. 5,409,050 teaches a window blind having pivotal slats which can be raised. There are two ladder holes in each slat which are located respectively near both ends of the long side of the slat and at a predetermined distance from a center line drawn along the longitudinal axis of the slat. Both ladder holes are corresponding in location to a first pair of operating cords and provided respectively with a slit extending in the same direction toward the edge of the same long side of the slat. Located by the ladder hole is a through hole for receiving a lifting cord. The first pair of the operating cords is received in the ladder holes through the slits. There is also a second pair of the operating cords which is so situated that its rung section supports the slat. As a result, an extension, unsupported section of the slat is formed. When the slats are so set as to keep out the light, the outer side edge of the extension section of an upper slat is lapped with the inner side edge of the extension section of a lower slat located immediately under the upper slat, thereby obstructing the through holes, concealing the operating cords and the lifting cord, and fully blocking the light. The slats may also be raised to allow full access to the window. Because the slat is supported only along its middle and along one edge, it is difficult to raise the free edge of the slats above the horizontal position. The angle of the slat cannot be adjusted to block light impinging on the blind from below. If the blind is used in an upper story window, or if the window is positioned near a body of water or snow, it is impossible to prevent others from looking into the room from below or to block the light reflected from below. Because the slat has a free edge wide enough to overlap the slat below, a blind of this design has a greater thickness than conventional blinds. Wider blinds protrude into the room and present an unattractive appearance.

U.S. Pat. No. 2,723,716 discloses a window blind slat having two sliding transverse portions arranged so that when the slat is rotated to a vertical position, adjacent slats overlap and cover the gap between adjacent slats and reduce the amount of light passing through the blind. Window blinds of this style are difficult and expensive to manufacture, subject to wear and unreliable in operation.

Efforts have also been made to eliminate the operating and lift cords from the interior of the blind slats. U.S. Pat. No. 5,375,642 discloses a horizontal blind having slats supported and operated by sets of attached flexible tilt members and raised by lift cords. The flexible tilt members have pins to support and operate the slats. The slats are counter-weighted to allow the lift members to operate the blind. When the slats are tilted, one set of flexible tilt members is raised relative to the other set. The counter-weighing feature assures that the slats will fully tilt. When the blind is raised, the flexible tilt members collapse allowing the blind to be raised without altering the angular position of the slats. All the merits of the structure notwithstanding, it is relatively complex and thus costly to manufacture.

One more patent addressing the problem is U.S. Pat. No. 5,423,367. A plurality of angle-shaped, or "V"-shaped slats are supported by ladder-shaped operating cords, which extend vertically from a bottom of a head box, and lifting cords, which extend from the head box through cord passage slots in the slats to a bottom rail of the blind. Each of the slats has a first, porous and semi-light-transmitting part extending from an apex portion of the slat to one side edge of the slat and a second, non-porous and non-light-transmitting part extending from the apex portion of the slat to another side edge of the slat. The structure provides a slight overlap of adjacent slats when the slats are fully tilted in one direction or the other. As a result, the lower edge of the upper slat slightly overlaps the upper corner of the lower slat, reducing the amount of light which passes between the slats. To exclude unwanted light, the cord passage slots formed in one surface of the slats extending to at least the apex of the "V" are used. When the slats are tilted into a position where the edges of the slats touch, each of the slots provides a recess for receiving the heavier lifting cord. Because of the non-planar "V" shape of the slats a significant portion of the blind blocks light when the slats are placed in the horizontal position such that when the blind is fully opened, a significant amount of transmitted light cannot pass through the opening. When conventional blinds are placed in the open position, the substantially flat slats allow more light to pass through the blind.

SUMMARY OF THE INVENTION

Therefore, a principal object of the present invention consists in providing a horizontal blind which would lack disadvantages of the prior art, yet keeping all their positive features.

Specifically, it is an object of the present invention to provide a horizontal blind which permits the transmitted light to be regulated from a maximum amount in a fully open position of the blind to a virtual blackout in the closed position thereof, while allowing the blind to be raised to expose the window.

For a better understanding of the nature and the foregoing and other objects and advantages of the present invention, the ensuing detailed description is provided. In the description, reference is made to the accompanying drawings which form an integral part of the specification. In these drawings, by way of illustration, there are shown preferred embodiments of the invention. Such embodiments, however, do not necessarily represent the full scope of the invention, and the claims are therefore to be addressed for interpreting the scope of the invention.

Briefly described in accordance with the best mode of practicing the invention, a horizontal or venetian blind comprises a plurality of slats suspended below a head box. In a transversal cross-section, each slat has first and second portions located in parallel planes, with a transition portion between them, and a flange attached to the second parallel portion at an obtuse angle, the parallel portions, the transition portion, and the flange portions extending the full length of the slat. The flange portion contains a passage hole for a lift cord. If the parallel portions are of about equal width, horizontal lines formed by transition portion bends will be in the middle of the slats, extending the whole length of the slats. In conjunction with the horizontal lines formed by the edges of the first portions of the slats, these midpoint-located transition lines make the closed blind appear like a mini-blind.

The slats are arranged with the parallel portions aligned, permitting the slats to nest on top of each other when the blind is raised.

The slats are supported by a ladder-like cord structure consisting of at least two pairs of operating vertical cords with interconnecting horizontal supporting cords. When one side of each pair of operating cords is raised relative to the other side, the angle of the slats is altered, changing the amount of light which passes through the blind. The supporting cords are regularly vertically spaced along the vertical cords. The vertical distance between the supporting cords is fixed to a distance less than the width of the blind so that tilting the slats causes the edge of the first portion to overlap at least a part of the second portion. When the slats are placed in the vertical position, the edge of the upper slat fully covers the flange portion with the cord passage opening of the lower slat, with no lifting cord between the slats, to secure a complete blackout.

DESCRIPTION OF THE PREFERRED EMBODIMENT

In order to better illustrate the advantages of the invention and its contributions to the art, a preferred embodiment of the invention will now be explained in some detail.

Figure 1A:
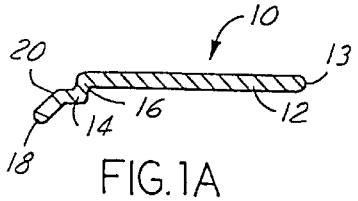
FIG. 1A illustrates a cross-sectional view of a slat in an embodiment of the present invention where the slat comprises two sections of unequal width.

Referring now to FIG. 1A, a cross-sectional view of a slat 10 according to the present invention shows the slat comprising two substantially flat portions: a first portion 12 (with an outer edge 13) and a second portion 14, which portions are located in parallel planes and connected with each other via a step-like transition portion 16, and a flange portion 18 extending backwardly and downwardly from the lower of the two portions 12 and 14, namely the second portion 14. Generally, the flange portion 18 projects from the second portion 14 at an obtuse angle thereto, the optimal angle being about 135°. The plane of the transition portion 16 is preferably normal to the planes of the first and second portions 12 and 14. The portions 12 and 14 which are preferably equally thick, the transition portion 16, and the flange portion 18 extend continuously for the whole length of the slat 10. Preferably, though not necessarily, the height of the step of the transition portion 16 is about the thickness of either of the two portions 12, 14, the convenience of which will be explained below in more detail. At least one opening 20 is provided in the flange portion 18. The opening 20 serves to pass a lifting cord (not shown in FIG. 1A) therethrough. Each slat may include a cord passage opening at each end and at other intermediary positions as required by the weight of the blind.

The slat 10 can be made of any suitable material, such as wood, metal, plastic, or a combination thereof. Specifically, a foam wood extrusion product can be used for the slats of the present invention. This product and method of making the same are disclosed in the copending U.S. patent application Ser. No. 08/821,188 filed Mar. 19, 1997, and assigned to the assignee of the present invention. The disclosure of the material and method is incorporated herein by reference.

Figure 1C:
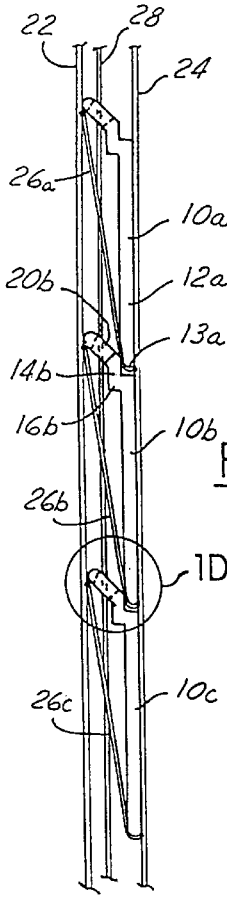
FIG. 1C illustrates the blind structure fragment of FIG. 1B with the slats oriented in the closed, vertical position and with a close-up view of the overlapping portion of adjacent slats where the mutual arrangement of the wider portion of the upper slat and the narrower portion of the lower slat and the flange is shown, specifically demonstrating how the cord passage opening permits the lifting cord to pass through the slats without passing between the adjacent slats.
Figure 1D:
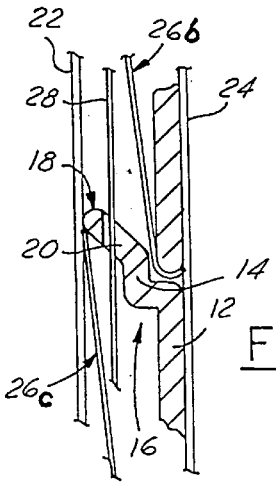
FIG. 1D is an enlarged and cross-sectional view of an encircled portion of FIG. 1C showing even more clearly an area of overlapping adjacent slats.
Figure 1B:
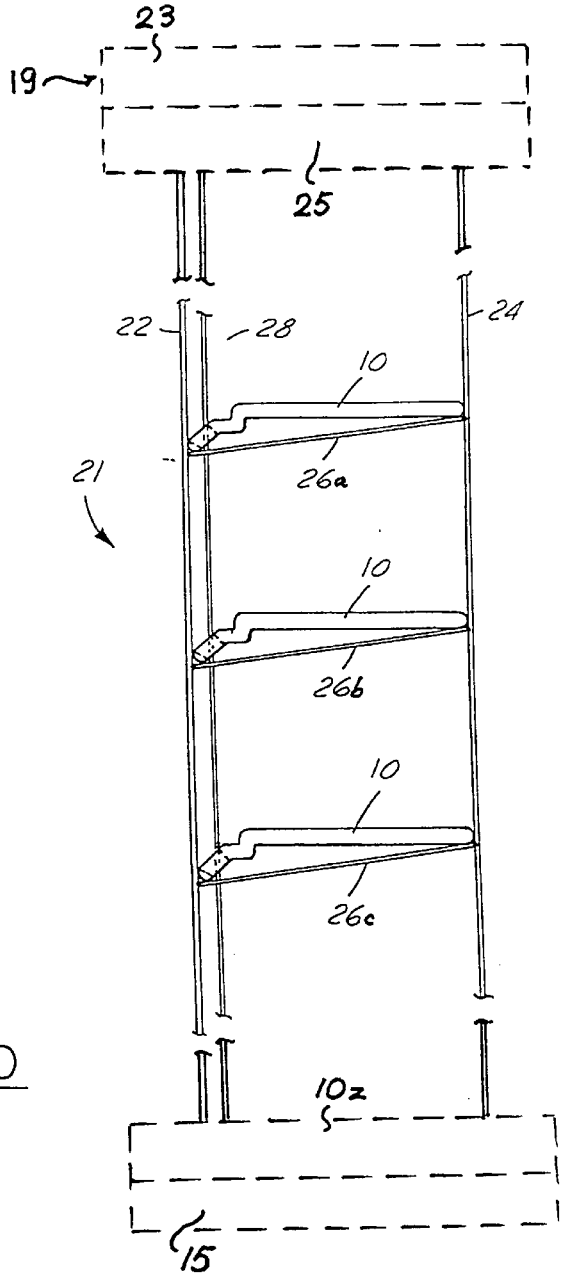
FIG. 1B illustrates a side view of a fragment of a blind structure having the ladder-like cord net, the lifting cords, and the cord passage openings, and using slats shown in FIG. 1A, with the slats oriented in the open, horizontal position.

FIGS. 1B and 1C illustrate a three-slat fragment of a blind structure 21 according to the present invention. Slats 10 are supported in this structure by a ladder-like cord net consisting of operating vertical cords 22 at a rear side of the blind structure facing a window and 24 at a front side thereof facing a room (if the area of application of the blind is covering the window in the room). The cords 22 and 24 are bridged by a plurality of cords 26, each of the cords 26 (shown as 26*a*, 26*b* and 26*c*) supporting a corresponding slat 10. It is obvious that from the balance standpoint the combination of the cords 22, 24, and 26 is preferably to be repeated at least once along the length of the slats. So there would be at least two supporting cords 26 for each slat 10, two vertical cords 22, and two vertical cords 24, the two combinations of cords 22, 24, 26 being spread over the length of the slats.

There is also provided at least one lifting cord 28 passing through the openings 20 in the slats 10 and affixed to the lowermost slat 10*z*, or to a conventional bottom rail 15. Also shown (in dotted lines) is head box 19 to which the operating cords 22 and 24 are attached and which accommodates a mechanism 25 for locking the lifting cord 28 in its selected position, as well as a mechanism for pulling or releasing the cords 22, 24 to rotate the slats 10 around their longitudinal axis to place them from the vertical into the horizontal position or vice versa, or in any intermediate position. As mentioned above, if constructional considerations require more than one lifting cord 28 to be provided, more than one opening 20 is accordingly to be made in each slat 10 to pass cords 28 therethrough.

The function of the supporting cords 26 and the lifting cord 28 is purely utilitarian so it is sufficient for them to be made thin yet strong enough to perform their functions. The cords 22 and 24 are visible and thus may also play a decorative role. For that reason, cords 22 and 24 can be made relatively thicker.

In FIG. 1B, the blind structure 21 is shown with the slats 10 tilted into the horizontal position to unobtrusively pass light through the structure. In FIG. 1C, to the contrary, the slats are placed into the vertical position. The vertical spacing of the supporting cords 26 should be less than the total width of the slat projected onto the plane of either of the first, 12, or the second, 14, portions of the slat 10. In other words, the vertical spacing of the supporting cords 26 is designed in such a way as to allow, for each pair of adjacent slats (e.g., 10*a*–10*b* or 10*b*–10*c* in FIG. 1C), the upper slat 10*a* to rest with its portion 12*a* in that vertical position on the transition portion 16*b* of the lower slat 10*b*, with only thin supporting cord 26*a* enveloping the edge 13*a* of the slat 10*a* to be in-between. The portion 12*a* overlaps the portion 14*b*, and thus light passing through the opening 20*b* in the flange portion 18*b* is blocked; it cannot find its way into the room, and thus a virtually complete blackout is attained. In practice, this goal is achieved by providing a regular vertical spacing of the supporting cords 26 equal to a total width of the slat 10 projected onto a plane of either of the first portion 12 or the second portion 14 minus a combined projected width of the flange portion 18 and the second portion 14.

If the height of the transition portion 16 is made substantially equal to the thickness of the portion 12, the surface of the portion 12*a* of the slat 10*a* facing the room turns out to be flush with the analogous surface of the portion 12*b* of the adjacent slat 10*b*. This feature, together with the portions 12 and 14 being parallel to each other, makes the whole structure aesthetically attractive.

To open the blind, lifting cords 28 are simultaneously raised from the head box. Raising the lifting cords 28 raises the lowermost slat 10 or alternatively the bottom rail which in turn raises the next lower slat 10, progressively collapsing the blind until all of the slats 10 have been elevated to the head box. Because the slats 10 are oriented with the portions 12 and portions 14 aligned, the slats 10 nest on top of one another in a compact bundle below the head box and completely expose the window or other opening.

Figure 2B:
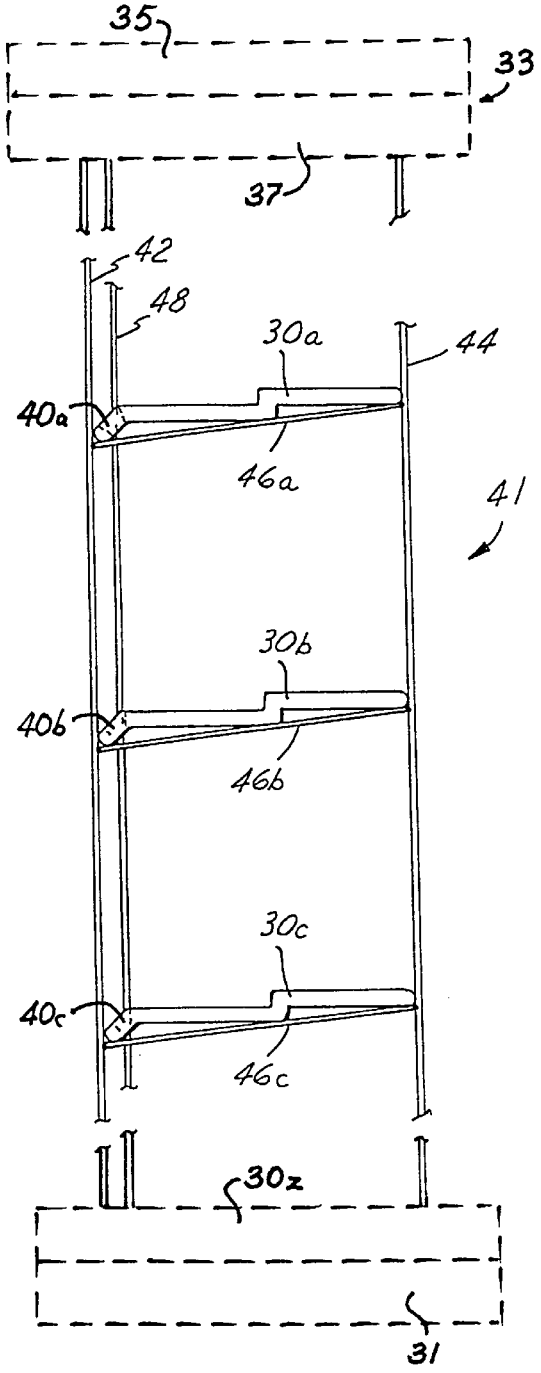
FIG. 2B illustrates a side view of a fragment of a blind structure comprising the ladder-like cord net, the lifting cords, and the cord passage openings, and using slats shown in FIG. 2A, with the slats oriented in the open, horizontal position.
Figure 2A:
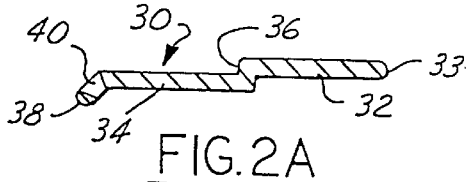
FIG. 2A illustrates a cross-sectional view of the slat in another embodiment of the present invention where the slat comprises two sections of approximately equal width.
Figure 2C:
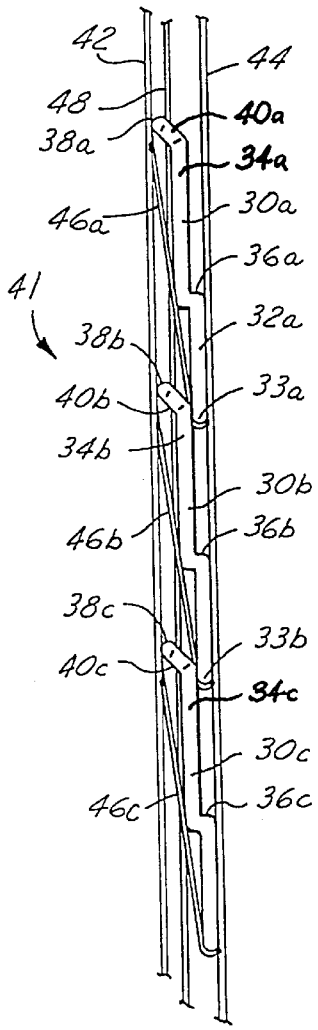
FIG. 2C is the blind structure fragment of FIG. 2B with the slats oriented in the closed, vertical position, showing the mutual arrangement of the overlapping portions of adjacent slats and particularly illustrating how the cord passage opening permits the lifting cord to pass through the slats without passing between the adjacent slats.

Substantially similar to the slat 10, a slat 30 shown in FIG. 2A also comprises parallel portions 32 and 34, the portion 32 extending transversely from its edge 33 to a step-like transition area formed by a transition portion 36, and the portion 34 (shown in FIG. 2C as 34*a*, 34*b*, and 34*c*) extending transversely from the step-like transition area to a flange portion 38 (see 38*a*, 38*b*, and 38*c* in FIG. 2C) projecting backwardly and downwardly from the portion 34. Generally, the flange portion 38 projects from the portion 34 at an obtuse angle thereto, the optimal angle being about 135°. At least one opening 40 is provided in the flange portion 38. (shown in FIGS. 2B and 2C are openings 40*a*, 40*b*, and 40*c*). The slat 30 differs from the slat 10 by the relative width of the portions 32 and 34 and by the location widthwise of the transition portion 36.

In the way analogous to that of FIGS. 1B and 1C, FIGS. 2B, 2C illustrate a three-slat fragment of a blind structure 41 according to the present invention. Slats 30 are supported in the structure by a ladder-like cord net containing an operating vertical cord 42 at a rear side of the blind structure facing a window and an operating vertical cord 44 at a front side thereof facing a room. The cords 42 and 44 are connected to each other by a plurality of cords 46, each of the cords 46 (shown as 46*a*, 46*b* and 46*c*) supporting a corresponding slat 30. Preferably, there are at least two combinations of the cords 22, 24, and 26 arranged along the length of the slats 30. In other words, there would be at least two supporting cords 46 for each slat 30, two vertical cords 42, and two vertical cords 44.

There is also provided at least one lifting cord 48 passing through the openings 40 in the slats 30 and affixed to the lowermost slat 30*z,* or to a conventional bottom rail 31. Also shown (in dotted lines) is a head box 33 to which the operating cords 42 and 44 are attached and which accommodates a mechanism 35 for locking the lifting cord 48 in its selected position, as well as a mechanism 37 for pulling or releasing the cords 42, 44 to rotate the slats 30 around their longitudinal axis to place them from the vertical into the horizontal, or vice versa, and in any intermediate position. As constructional considerations usually require more than one lifting cord 48 to be provided, more than one opening 40 is accordingly to be made in each slat 30 to pass cords 48 therethrough.

Referring now to FIG. 2B, the blind structure 41 is shown with the slats 30 tilted into the horizontal position to freely let light through the structure. In FIG. 2C, on the other hand, the slats 30 are shown placed into the vertical position. To prevent the light from passing through the blind in its closed, vertical condition, the vertical spacing of the supporting cords 46 is selected in such a way as to be less than the total width of the slat 30 projected onto the plane of either of the first portion 32 or the second portion 34 by the amount more than a projected width of said flange portion. Also, the vertical spacing is designed for this embodiment in such a way as to allow each slat (30*a,* 30*b,* and 30*c* in FIG. 2C) to look half as wide due to horizontal separating lines formed by the outer ends 33 (33*a* and 33*b* in FIG. 2C) and the transition portions 36 (36*a,* 36*b,* and 36*c* in FIG. 2C). To this end, the width of the portion 34 is selected to exceed the width of the portion 32 just by the amount of the overlapping, and the whole structure will look like miniblind.

As far as width of the slat parallel portions is concerned, there is but one limitation, and the limitation is that the portion 14 (34) of the lower slat (say 10(30)*b* or 10(30)*c*) of two adjacent slats 10 (30) must be wide enough (hang down in the slats' vertical position) for the portion 12 (32) of the upper one (say 10(30)*a* or 10(30)*b,* respectively) to reliably overlap it and prevent light from passing through the blind structure 21 (41), to thereby secure a virtually complete blackout.

One more characteristic feature of the blind structure disclosed herein, which feature contributes to the overall effect of the present invention, is that the lifting cords 28 (48) are invisible in the closed position of the structure 21 (41). This is achieved because the flanges 18 (38) containing the lifting cord passage openings 20 (40) are made projecting backwardly and downwardly from the portions 14 (34) of the slats 10 (30). Thus, the cords 28 (48) are put beyond the vertical plane in which the portions 14 (34) are in the blackout position of the structure 21 (41), with the openings 20 (40) of a lower slat completely covered by the portions 12 (32) of an adjacent upper one.

While only two embodiments of the present invention have been disclosed hereinabove, it is to be understood that these embodiments of the blind are given by example only and not in a limiting sense. Those skilled in the art may make various modifications and additions to the preferred embodiments chosen to illustrate the invention without departing from the spirit and scope of the present contribution to the art. Accordingly, it is to be realized that the patent protection sought and to be afforded hereby shall be deemed to extend to the subject matter claimed and all equivalents thereof fairly within the scope of the invention.

What is claimed is:

1. A horizontal blind having a head box and an operating means, comprising:

a. a plurality of slats, each of said slats comprising widthwise first and second portions located in parallel planes, and a flange portion, said first portion having an outer edge, said second portion being between said first portion and said flange portion and being connected to said first portion through a transition portion, said flange portion projecting rearwardly from said second portion at an obtuse angle thereto, said first portion, said second portion, said transition portion, and said flange portion extending a full length of the slat, said flange portion being provided with at least one opening made therein;

b. at least one lifting cord for raising and lowering said slats, said lifting cord operable by said operating means and extending from said head box to a bottom slat and passing through said at least one opening in said flange portion of said each of said slats; and c. at least two adjustable ladder cord structures operable by said operating means for tilting said slats, said structures depending from said head box and extending to said bottom slat, each of said at least two ladder cord structures having a first vertical cord portion, a second vertical cord portion, and a plurality of horizontal cord portions attached to said first and said second vertical portions for supporting said slats, said horizontal cord portions being vertically and regularly spaced along a length of said first and said second vertical cord portions, said vertical spacing being less than a total width of said slat projected onto a plane of either of said first portion or said second portion by more than a projected width of said flange portion;

whereby in their closed, vertical position, an overlapping of said slats with no lifting cord passage therebetween and a virtual blackout is secured.

2. The horizontal blind as claimed in claim 1, wherein said vertical spacing being equal to said total projected width of said slat minus a combined projected width of said flange portion and said second portion.

3. The horizontal blind as claimed in claim 1, wherein said first portion is made shorter than said second portion by the amount of said overlapping.

* * * * *